US012565694B2

(12) United States Patent
Yu et al.

(10) Patent No.: US 12,565,694 B2
(45) Date of Patent: Mar. 3, 2026

(54) METHOD FOR EXTRACTING LITHIUM FROM SALT LAKE BRINE

(71) Applicants: SUNRESIN NEW MATERIALS CO. LTD., Shaanxi (CN); MINMETALS SALT LAKE CO., LTD., Haixi Mongolian (CN)

(72) Inventors: Jia Yu, Shaanxi (CN); Zengrong Li, Shaanxi (CN); Dayi Zhang, Shaanxi (CN); Fumin Guo, Shaanxi (CN); Zhaofei Hou, Shaanxi (CN); Faman Tang, Shaanxi (CN); Mian Wang, Shaanxi (CN); Zhibo Luo, Shaanxi (CN); Chao Zan, Shaanxi (CN); Suidang Li, Shaanxi (CN); Qiong Liu, Shaanxi (CN); Yongxiao Song, Shaanxi (CN); Yun Wang, Shaanxi (CN); Xiaokang Kou, Shaanxi (CN)

(73) Assignees: SUNRESIN NEW MATERIALS CO. LTD., Xi'an (CN); MINMETALS SALT LAKE CO., LTD, Xi'an (CN)

( * ) Notice: Subject to any disclaimer, the term of this patent is extended or adjusted under 35 U.S.C. 154(b) by 785 days.

(21) Appl. No.: 17/778,776

(22) PCT Filed: Dec. 16, 2020

(86) PCT No.: PCT/CN2020/136821

§ 371 (c)(1),
(2) Date: May 20, 2022

(87) PCT Pub. No.: WO2021/135946

PCT Pub. Date: Jul. 8, 2021

(65) Prior Publication Data

US 2023/0002854 A1 Jan. 5, 2023

(30) Foreign Application Priority Data

Dec. 30, 2019 (CN) ..... 201911395001.X

(51) Int. Cl.
*C22B 26/12* (2006.01)
*C22B 3/24* (2006.01)

(52) U.S. Cl.
CPC ..... *C22B 26/12* (2013.01); *C22B 3/24* (2013.01)

(58) Field of Classification Search
CPC ..... B01D 15/1864; C22B 26/12; C22B 3/24; C22B 3/42; Y02P 10/20
See application file for complete search history.

(56) References Cited

U.S. PATENT DOCUMENTS 6,461,502 B1 10/2002 Nobukawa
2004/0074774 A1* 4/2004 Chang ..... B01J 20/2803 204/523
2018/0222760 A1 8/2018 Reed et al.

FOREIGN PATENT DOCUMENTS

CL 2018000333 A1 2/2018
CL 2018000938 A1 2/2019
(Continued)

OTHER PUBLICATIONS

Office action received for Chilian patent application No. 202201789, mailed on Nov. 30, 2023, 25 pages (11 pages of English translation and 14 pages of official copy).
(Continued)

*Primary Examiner* — Jie Yang
(74) *Attorney, Agent, or Firm* — Maschoff Brennan

(57) ABSTRACT

A new method for extracting lithium from salt lake brine, comprising the following steps: a salt lake old brine raw material, desorption liquid, low-magnesium water, and adsorption tail liquid pass through an old brine feeding pipe (2), a desorption liquid feeding pipe (4), a low-magnesium water top desorption liquid feeding pipe (3), and an adsorption tail liquid top desorption liquid feeding pipe (11),
(Continued)

respectively, which are located above and below a rotary disc of a multi-way valve system (1); and after respectively entering corresponding adsorption columns (6) by means of a duct and channel within the multi-way valve system (1), the entire process procedure is completed from an adsorption tail liquid discharge pipe (7), a qualified desorption liquid discharge pipe (10), a lithium-containing old brine discharge pipe (8), and an adsorption tail liquid top desorption liquid discharge pipe (5); and the adsorption columns (6) are connected in series or in parallel by means of channels located in the multi-way valve system (1). The feature in which a multi-way valve device is simple and easy to operate is utilized, and in comparison with a fixed bed operating system, the utilization rate of lithium adsorbent may be increased by over 20%, the utilization efficiency of the lithium adsorbent may be increased by over 40%, and production costs may be reduced by 30-50%. Therefore, the stability of a qualified desorption liquid is improved, stable production is guaranteed, and year-round constant operation may be achieved.

6 Claims, 2 Drawing Sheets

(56) References Cited

FOREIGN PATENT DOCUMENTS

| | | | |
|---|---|---|---|
| CN | 1452513 | A | 10/2003 |
| CN | 101928828 | A | 12/2010 |
| CN | 102031368 | A | 4/2011 |
| CN | 102703703 | A | 10/2012 |
| CN | 104313348 | A | 1/2015 |
| CN | 105797428 | A | 7/2016 |
| CN | 105836766 | A | 8/2016 |
| CN | 107058735 | A | 8/2017 |
| CN | 107949541 | A | 4/2018 |
| CN | 108893605 | B | 11/2018 |
| CN | 110004306 | A | 7/2019 |
| CN | 111041201 | A | 4/2020 |
| WO | 2019221932 | A1 | 11/2019 |

OTHER PUBLICATIONS

Office action received for Chilian patent application No. 202201789, mailed on May 30, 2024, 23 pages (10 pages of English translation and 13 pages of official copy).

Office action received for Turkish patent application No. 2022/010649, mailed on Sep. 11, 2024, 3 pages (2 pages of English translation and 1 page of official copy).

Extended European Search Report for corresponding EP Application No. 20909597.5, issued Apr. 17, 2023, from the EP Patent Office.

Ryabtsev Ad et al: "Production of Lithium Hydroxide Monohydrate from Natural Brine", Theoretical Foundations of Chemical Engineering, Pleiades Publishing, Moscow, Sep. 5, 2019.

Williams Alan E. et al: "A brine interface in the Salton Sea Geothermal System, California: Fluid geochemical and isotopic characteristics", Geochimico et Cosmochimico Acta, Aug. 31, 1989.

International Search Report issued in connection with international application No. PCT/CN2020/136821 on Mar. 16, 2021, from the China National Intellectual Property Administration.

Written Opinion ssued in connection with international application No. PCT/CN2020/136821 on Mar. 16, 2021, from the China National Intellectual Property Administration.

Fist Office Action issued in connection with Chinese application No. CN201911395001X on Jan. 25, 2021, from the China National Intellectual Property Administration.

Second Office Action issued in connection with Chinese application No. CN201911395001X on Sep. 16, 2021, from the China National Intellectual Property Administration.

Decision on Refusal issued in connection with Chinese application No. CN201911395001X on Mar. 22, 2022, from the China National Intellectual Property Administration.

* cited by examiner

METHOD FOR EXTRACTING LITHIUM FROM SALT LAKE BRINE

CROSS-REFERENCE TO RELATED APPLICATIONS

The present application is the U.S. National Stage application of International Application No. PCT/CN2020/136821, filed Dec. 16, 2020, which International Application was published on Jul. 8, 2021, as International Publication No. WO2021/135946. The International Application claims priority to Chinese Patent Application No. 201911395001.X, filed Dec. 30, 2019, the contents of which are incorporated herein by reference in their entireties.

TECHNICAL FIELD

The invention relates to a new method for extracting lithium from salt lake brine, and belongs to the field of hydrometallurgy.

BACKGROUND

Metal lithium and its compounds have great application prospects in energy and new materials. Lithium extraction from salt lake brine will become the main direction of lithium salt production in the 21st century. Lithium resources in nature mainly occur in granite pegmatite-type deposits, salt lake brine, seawater and geothermal water. According to statistics, the reserves of lithium resources in salt lake brine account for about 70-80% of the total lithium resources. Therefore, lithium extraction from salt lake brine will become the main way of lithium salt production. The global lithium salt products produced from brine (calculated in terms of lithium carbonate) has accounted for more than 85% of the total lithium products.

Lithium-containing salt lake brine generally contains magnesium ions, and the magnesium content directly affects the extraction of lithium. Generally, when a magnesium-to-lithium ratio (Mg/Li) is lower than 8-10, the natural evaporation concentration-precipitation method can be used; and if it is higher than 10, the magnesium and lithium are not easily separated. The technical methods of extracting lithium salt from salt lake brine at home and abroad mainly include precipitation method, extraction method, ion exchange adsorption method, carbonization method, calcination leaching method, Xu's method and electrodialysis method, etc. Among them, the precipitation method, the extraction method, the adsorption method and the carbonization method have been extensively studied and are the main methods for extracting lithium from salt lake brine. The extraction of lithium salts from brine generally adopts evaporation-crystallization-precipitation in industry, and all the final products are lithium carbonate. The precipitation method is feasible, but the process flow is long, the material turnover is large, multiple calcinations are required, the operation steps are complicated, the final lithium leaching solution has a low concentration of lithium and requires a large power cost to concentrate. The extraction method has a high recovery rate, but the process flow is long, the equipment corrosion is serious, and the production cost is high, making it difficult to achieve industrialization. The resin adsorption method is to use lithium ion exchange adsorbents such as titanium dioxide, metal phosphates, composite antimonates, aluminum salt type adsorbents and organic ion exchange resins to selectively treat salt lake brine with high magnesium-to-lithium ratio. The selective adsorbent is used to adsorb lithium ions, and then the lithium ions are eluted to achieve the purpose of separating lithium ions from other impurity ions. This method is simple in process, high in recovery rate and good in selectivity, and has great advantages compared with other methods. However, in the process of the precipitation method, extraction method and carbonization method, it is necessary to introduce a deep magnesium removal process, which increases the process steps and production cost and reduces the yield of lithium. Therefore, it is of great significance in economic value and environmental protection to promote the process of lithium carbonate in salt lakes with relatively high lithium content such as Taijnaier Lake and Yiliping in the Qaidam Basin of Qinghai Province in China.

CN1511964 discloses a method for extracting lithium from salt lake brine by adsorption method, which is suitable for lithium-containing salt lake brine in Qinghai and concentrated lithium-containing brine in salt fields, and suitable for the process of preparing lithium carbonate and lithium chloride from Qinghai salt lake brine; wherein aiming at the concentrated lithium-containing brine obtained by evaporating in the sun in the salt field, the Li+ is adsorbed with an aluminum salt type adsorbent, and the Li+ is eluted with water to obtain an effluent, and magnesium is removed from the effluent and then the effluent is concentrated to meet the qualified raw materials required for the preparation of lithium carbonate or lithium chloride. The lithium ion adsorption efficiency of this method is low, and a deep magnesium removal process is required, so the production cost is high.

CN102031368 discloses a continuous ion exchange device and a method for extracting lithium from salt lake brine, and the method adopts a valve array to realize the whole process. In the device, since there are many valves used in the device, the valve program control is complicated, and the use and maintenance costs are high.

CN1452513A discloses a fluid treating device, which comprises a distributing device with a revolving disc in a stationary housing, and a motor for rotating the revolving disc, through the feeding pipe and the discharging pipe contained on the distributing device to contact with the solid material inside the container, thereby realizing the fluid treatment process. The method mainly proposes a device structure and fluid distribution method, but does not involve a specific production process and method, and has no operability and production practice.

SUMMARY OF THE INVENTION

In order to solve the problems of low adsorbent utilization rate and low utilization efficiency and high production and processing costs in the process of extracting lithium from salt lake brine in the prior art, the present invention provides a new method for extracting lithium from salt lake brine, in which a continuous adsorption system with a multi-way valve is combined with the lithium adsorbent. In the process of use, series or parallel connected multiple columns are combined with the switching mode of the multi-way valve, so that quick adsorption of lithium is achieved when the material liquid flows through the bed. The steps of adsorption, pushing back of material by low-magnesium solution, desorption, pushing back of desorption solution by barren brine and the like in the whole process are operated simultaneously through automatic control, and the adsorption of lithium can be effectively realized by the above method. This method has the advantages of simple operation, low operating cost and high production efficiency.

For realizing the above-mentioned technical purpose, the present invention adopts the following technical solutions:

allowing a salt lake brine, desorption solution, low-magnesium solution and barren brine to pass through a feeding pipe for brine, a feeding pipe for desorption solution, a feeding pipe for low-magnesium solution for pushing back desorption solution and a feeding pipe for barren brine for pushing back desorption solution respectively, wherein the feeding pipes are located above and below a rotary disc of a multi-way valve system, then pass through openings and channels within the multi-way valve system to respectively enter corresponding adsorption columns, and finally discharge from a discharging pipe for barren brine, a discharging pipe for qualified liquid, a discharging pipe for lithium-containing brine and a discharging pipe for barren brine for pushing back desorption solution, thereby completing the whole process, wherein the adsorption columns are connected in series or in parallel via the channels in the multi-way valve system; and wherein the whole process comprises the following steps:

(1) in an adsorption zone, carrying out: feeding an brine from a tank for brine into an adsorption tower N1 through the feeding pipe for brine to perform adsorption of lithium ions onto an adsorbent, producing an barren brine free of lithium, and discharging the barren brine free of lithium into a tank for barren brine through the discharging pipe for barren brine;

(2) in a zone for replacing by low-magnesium solution, carrying out the following after the adsorbent is saturated: feeding a low-magnesium solution from a tank for low-magnesium solution into an adsorption tower N2 through a feeding pipe for low-magnesium solution to push back the lithium-containing brine that is not adsorbed by the adsorbent to the tank for brine to wait for the next adsorption;

(3) in a desorption zone by desorption solution, carrying out the following after the completion of pushing back lithium-containing brine by the low-magnesium solution: feeding a desorption solution from a tank for desorption solution into an adsorption tower N3 through the feeding pipe for desorption solution to desorb the resin, producing a rich solution, of which a first half is discharged through a discharging pipe for low-magnesium to the tank for low-magnesium solution for use in the zone for replacing by low-magnesium solution, and a second half is discharged into a tank for the qualified liquid and finally sent to the next step;

(4) in a zone for pushing back desorption solution by barren brine, some desorption solution containing trace lithium was left in the resin column after the desorption of the adsorbent was completed, and in order to recover the left desorption solution and thus reduce consumption, the left desorption solution in the adsorption column was replaced by the barren brine, comprising: feeding the barren brine from the tank for barren brine into an adsorption tower N4 through the feeding pipe for barren brine for pushing back desorption solution, and discharging the desorption solution containing trace lithium through a discharging pipe for desorption solution recovery into the tank for desorption solution;

The number of the adsorption towers N1, N2, N3 and N4 is one or more, connected in series or parallel mode, and the number of the adsorption towers N1, N2, N3 and N4 can be matched with the channels of the multi-way valve system according to process requirements. Each of the adsorption tower is filled with a lithium ion adsorbent.

The desorption solution is selected from the group consisting of 0.1-50% (w/w) aqueous electrolyte solution, desalted water, 0.1-50% (w/w) saline solution, 0.1-36% (w/w) hydrochloric acid solution, 0.1-50% (w/w) sodium hydroxide solution, and any mixture thereof; preferably 0.5% (w/w) aqueous electrolyte solution, desalted water or 0.5% (w/w) hydrochloric acid solution; and most preferably desalted water.

The temperature of the desorption solution is 5-60° C., preferably 10-50° C., more preferably 30-40° C.

The rotation switching time of the multi-way valve system is 0.01-24 hours.

The invention provides a new method for extracting lithium from a salt lake, which combines a multi-way valve continuous adsorption system with an adsorption process for extracting lithium from a salt lake, and innovatively proposes a new method for continuous lithium extraction technology. Using the simple and easy-to-operate characteristics of multi-way valve equipment, combined with the process specificity of lithium extraction from a salt lake, compared with the fixed bed operation system, the utilization rate of lithium adsorbents can be increased by more than 20%, and the utilization efficiency of lithium adsorbents can be increased by 40%, and the production cost can be reduced by 30-50%. The multi-way valve equipment has a simple structure, and compared with the valve array, the maintenance and use costs are lower; and the multi-way valve system adopts full-sealing and interval operation between brine and desorption solution, which reduces the risk of mixing of material liquids in the brine adsorption zone and desorption zone, improves the stability of the qualified liquid, ensures stable production and can achieve year-round operation.

DETAILED DESCRIPTION

In order to make the content of the present invention easier to understand clearly, the present invention will be described in further detail below according to specific embodiments of the present invention and in conjunction with the accompanying drawings.

Figure 1:
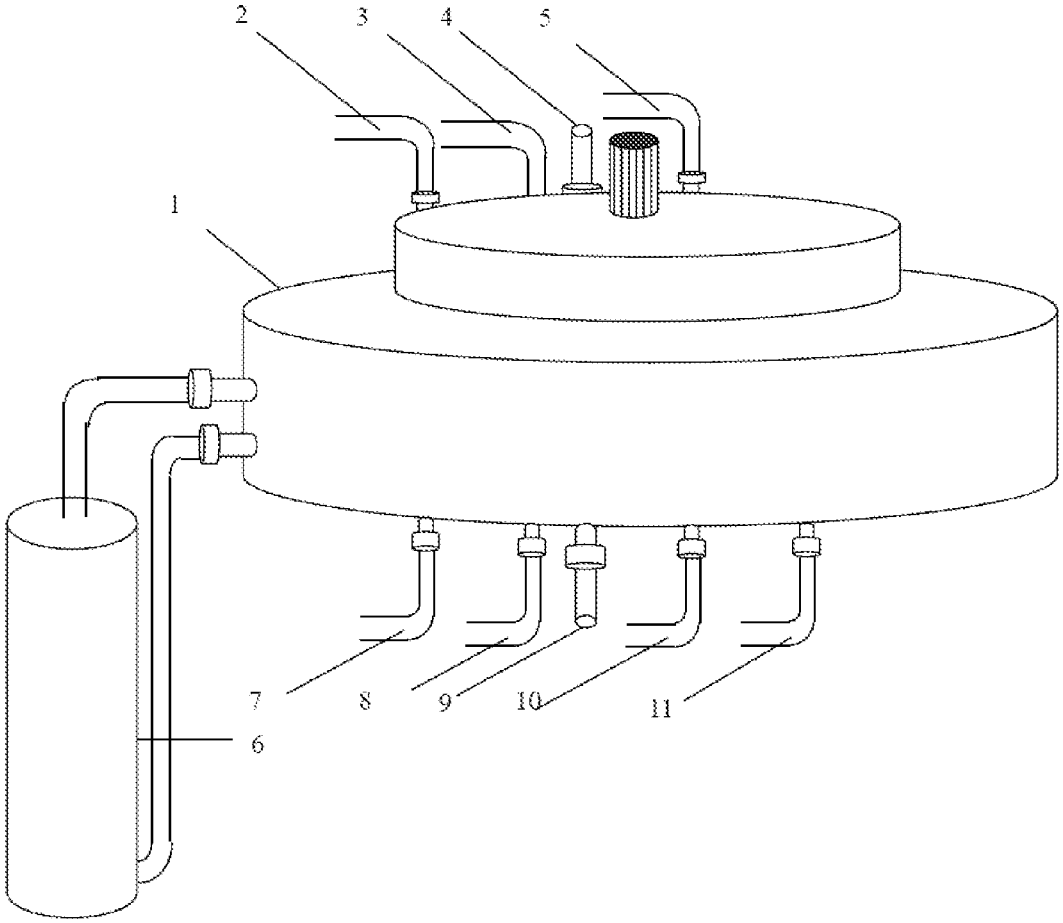
FIG. 1 is a schematic diagram of inlet and outlet pipelines of the multi-way valve system.

FIG. 1 is a schematic diagram of inlet and outlet pipelines of a multi-way valve system, wherein: 1. multi-way valve system;

2. feeding pipe for brine;
3. feeding pipe for low-magnesium solution for pushing back desorption solution;
4. feeding pipe for desorption solution;
5. discharging pipe for barren brine for pushing back desorption solution;
6. adsorption column;
7. discharging pipe for barren brine;
8. discharging pipe for lithium-containing brine;
9. discharging pipe for low-magnesium solution;
10. discharging pipe for qualified liquid;
11. feeding pipe for barren brine for pushing back desorption solution.

Figure 2:
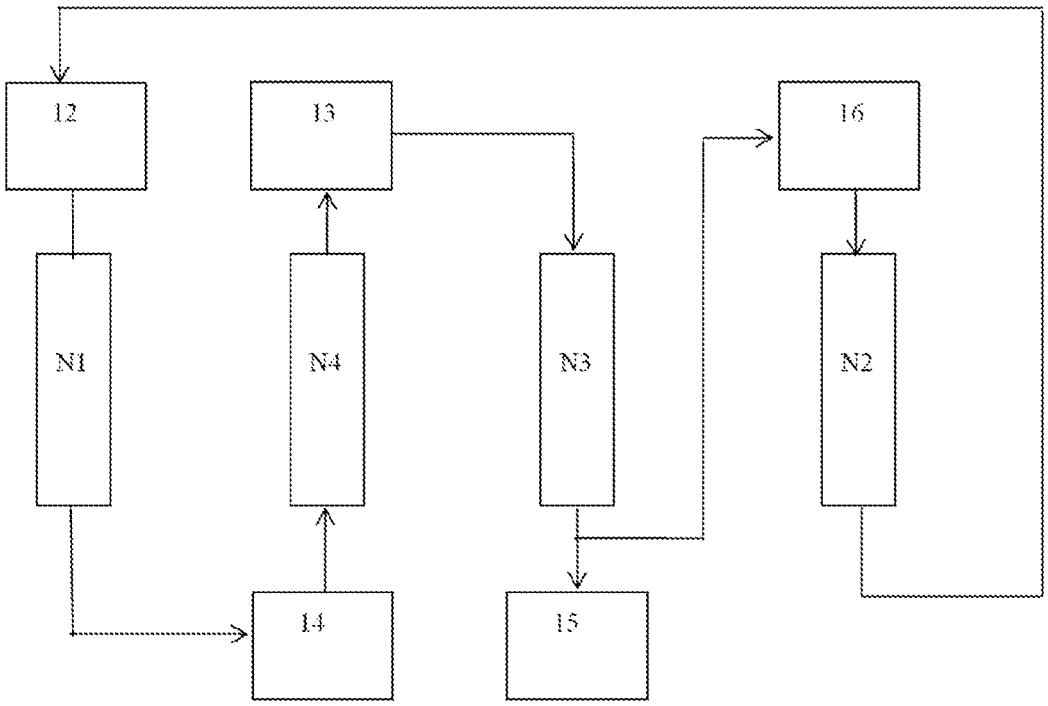
FIG. 2 is a schematic diagram of process flow of lithium extraction from salt lake brine.

FIG. 2 is a schematic diagram of process flow of lithium extraction from salt lake brine, wherein:

12. tank for brine;
13. tank for desorption solution;
14. tank for barren brine;

15. tank for qualified liquid;

16. tank for low-magnesium solution;

N1, N2, N3, N4: adsorption towers.

Example 1

An brine, desalted water at −38° C. as desorption solution, low-magnesium solution, and barren brine were passed through a feeding pipe 2 for brine, a feeding pipe 3 for low-magnesium solution for pushing back desorption solution, a feeding pipe 4 for desorption solution, and a feeding pipe 11 for barren brine for pushing back desorption solution respectively wherein the feeding pipes 2, 3, 4 and 11 were located above and below a rotary disc of a multi-way valve system 1 (with a valve diameter of 1.5 inches, a rotation switching time of 0.5 h), then passed through openings and channels within the multi-way valve system to respectively enter corresponding adsorption columns 6 (filled with Lithium adsorbent LX-10Li, produced by XI'AN SUN-RESIN NEW MATERIALS CO., LTD.), and finally respectively discharged from the a discharging pipe 7 for barren brine, a discharging pipe 8 for lithium-containing brine, a discharging pipe 9 for low-magnesium solution and a discharging pipe 10 for qualified liquid, thereby completing the whole process.

The distribution of each zone was as follows:

1. Adsorption zone: An brine from an tank 12 for brine entered adsorption columns 1 # to 12 # (twelve adsorption columns operated in series through the channels in the multi-way valve, forming an adsorption tower N1) through the feeding pipe 2 for brine, so that lithium ions were adsorbed on the adsorbent, and the brine which was free of lithium ions after adsorption entered a tank 14 for barren brine through the discharging pipe for barren brine.

2. Zone for pushing back brine by low-magnesium solution: After the adsorbent was saturated, low-magnesium solution from the tank 16 for low-magnesium solution entered adsorption columns 13 # to 17 # (i.e. five adsorption columns operated in series through the channels in the multi-way valve, forming an adsorption tower N2) through the feeding pipe 3 for low-magnesium solution for pushing back desorption solution, so that the lithium-containing brine was pushed back by the low-magnesium solution to the tank 12 for brine to wait for the next adsorption.

3. Desorption zone by desorption solution: After the completion of pushing back lithium-containing brine by the low-magnesium solution, desalted water as desorption solution from the tank 13 for desorption solution entered adsorption columns 18 # to 27 # (ten adsorption columns operated in series through the channels in the multi-way valve, forming a adsorption tower N3) through the feeding pipe 4 for desorption solution to desorb the resin, resulting in a rich solution, of which a first half was discharged from the discharging pipe 10 for low-magnesium to the tank 16 for low-magnesium solution for use in the zone for pushing back brine by low-magnesium solution, and a second half was discharged into a tank 15 for the qualified liquid and was finally sent to a next step.

4. Zone for pushing back desorption solution by barren brine: After the desorption of the adsorbent was completed, some desorption solution containing trace lithium was left in the resin column, and in order to recover the left desorption solution and thus reduce consumption, the left desorption solution in the adsorption column was pushed back by the barren brine. The barren brine from the tank 14 for barren brine entered the adsorption column 28 # (one adsorption column operated in a single column, that is, the adsorption tower N4) through the feeding pipe 11 for barren brine for pushing back desorption solution, and the desorption solution containing trace lithium was discharged from the discharging pipe for desorption solution recovery into the tank for desorption solution.

The system had a feed flow rate of 2 t/h for the brine, twenty-eight resin columns in total, with each column being filled with 1 $m^3$ of resin and the total amount of adsorbent in the system being 28 $m^3$, and a switching time of 30 min. The brine at inlet had a lithium content of 3000 ppm and a magnesium ion concentration of 120 g/L. After treatment by the system, the adsorption tail fluid had a lithium ion concentration of 10 ppm and a magnesium ion concentration of 110 g/L. The qualified liquid had a lithium ion concentration of 650 ppm and a magnesium ion concentration of 1.5 g/L. For comparison, a fixed bed system had a feed flow rate of 2 t/h, three resin columns in total, with each column being filled with 20 $m^3$ of resin and the total amount of resin in the system being 60 $m^3$, a lithium content of 3000 ppm at inlet, and a magnesium ion concentration of 120 g/L at inlet. After treatment by the fixed bed system, the barren brine had a lithium ion content of 400 ppm, and the qualified liquid had a lithium ion concentration of 300 ppm and a magnesium ion concentration of 3 g/L.

Example 2

An brine, desalted water at −10° C. as desorption solution, low-magnesium solution, and barren brine were passed through a feeding pipe 2 for brine, a feeding pipe 3 for low-magnesium solution for pushing back desorption solution, a feeding pipe 4 for desorption solution, and a feeding pipe 11 for barren brine for pushing back desorption solution respectively wherein the feeding pipes 2, 3, 4 and 11 were located above and below a rotary disc of a multi-way valve system 1 (with a valve diameter of 1.5 inches, a rotation switching time of 1 h), then passed through openings and channels within the multi-way valve system to respectively enter corresponding adsorption columns 6 (filled with Lithium adsorbent LX-10Li, produced by XI'AN SUN-RESIN NEW MATERIALS CO., LTD.), and finally respectively discharged from a discharging pipe 7 for barren brine, a discharging pipe 8 for lithium-containing brine, a discharging pipe 9 for low-magnesium solution and a discharging pipe 10 for qualified liquid, thereby completing the whole process.

The distribution of each zone was as follows:

1. Adsorption zone: An brine from an tank 12 for brine entered adsorption columns 2 # to 13 # (twelve adsorption columns operated in parallel through the channels in the multi-way valve, forming an adsorption tower N1) through the feeding pipe 2 for brine, so that lithium ions were adsorbed on the adsorbent, and the brine which was free of lithium ions after adsorption entered a tank 14 for barren brine through the discharging pipe 7 for barren brine.

2. Zone for pushing back brine by low-magnesium solution: After the adsorbent was saturated, low-magnesium solution from the tank 16 for low-magnesium solution entered adsorption columns 14 # to 18 # (five adsorption columns operated in parallel through the channels in the multi-way valve, forming an adsorption tower N2) through the feeding pipe 3 for low-magnesium solution for pushing back desorption solution, so that the lithium-containing brine was pushed back by the low-magnesium solution to the tank 12 for brine to wait for the next adsorption.

3. Desorption zone by desorption solution: After the completion of pushing back lithium-containing brine by the low-magnesium solution, desorption solution from the tank 13 for desorption solution entered adsorption columns 19 # to 28 # (ten adsorption columns operated in series through the channels in the multi-way valve, forming an adsorption tower N3) through the feeding pipe 4 for desorption solution to desorb the resin, resulting in a rich solution, of which a first half was discharged from the discharging pipe 10 for low-magnesium to the tank 16 for low-magnesium solution for use in the zone for pushing back brine by low-magnesium solution, and a second half was discharged into the tank 15 for the qualified liquid and was finally sent to a next step.

4. Zone for pushing back desorption solution by barren brine: After the desorption of the adsorbent was completed, some desorption solution containing trace lithium was left in the resin column, and in order to recover the left desorption solution and thus reduce consumption, the left desorption solution in the adsorption column was pushed back by the barren brine. The barren brine from the tank 14 for barren brine entered the adsorption column 1 # (one adsorption column operated in a single column, that is, the adsorption tower N4) through the feeding pipe 11 for barren brine for pushing back desorption solution, and the desorption solution containing trace lithium was discharged from the discharging pipe for desorption solution recovery into the tank for desorption solution.

The system had a feed flow rate of 2 t/h for the brine, twenty-eight resin columns in total, with each column being filled with 1 $m^3$ of resin and the total amount of adsorbent in the system being 28 $m^3$, and a switching time of 60 min. The brine at inlet had a lithium content of 3000 ppm and a magnesium ion concentration of 120 g/L. After treatment by the system, the adsorption tail fluid had a lithium ion concentration of 9 ppm and a magnesium ion concentration of 110 g/L. The qualified liquid had a lithium ion concentration of 430 ppm and a magnesium ion concentration of 2.7 g/L.

Example 3

An brine, desalted water at −20° C. as desorption solution, low-magnesium solution, and barren brine were passed through a feeding pipe 2 for brine, a feeding pipe 3 for low-magnesium solution for pushing back desorption solution, a feeding pipe 4 for desorption solution, and a feeding pipe 11 for barren brine for pushing back desorption solution respectively wherein the feeding pipes 2, 3, 4 and 11 were located above and below a rotary disc of a multi-way valve system 1 (with a valve diameter of 1.5 inches, a rotation switching time of 2 h), then passed through openings and channels within the multi-way valve system to respectively enter corresponding adsorption columns 6 (filled with Lithium adsorbent LX-10Li, produced by XI'AN SUN-RESIN NEW MATERIALS CO., LTD.), and finally respectively discharged from the a discharging pipe 7 for barren brine, a discharging pipe 8 for lithium-containing brine, a discharging pipe 9 for low-magnesium solution and a discharging pipe 10 for qualified liquid, thereby completing the whole process.

The distribution of each zone was as follows:

1. Adsorption zone: An brine from an tank 12 for brine entered adsorption columns 3 # to 14 # in adsorption columns sets (twelve adsorption columns operated in series through the channels in the multi-way valve, forming an adsorption tower N1) through the feeding pipe 2 for brine, so that lithium ions were adsorbed on the adsorbent, and the brine which was free of lithium ions after adsorption entered a tank 14 for barren brine tank through the discharging pipe 7 for barren brine.

2. Zone for pushing back brine by low-magnesium solution: After the adsorbent was saturated, the low-magnesium solution from the tank 16 for low-magnesium solution entered adsorption columns 15 # to 19 # (five adsorption columns operated in parallel through the channels in the multi-way valve, forming an adsorption tower N2) through the feeding pipe 3 for low-magnesium solution for pushing back desorption solution, so that the lithium-containing brine was pushed back by the low-magnesium solution to the tank 12 for brine to wait for the next adsorption.

3. Desorption zone by desorption solution: After the completion of pushing back lithium-containing brine by the low-magnesium solution, desorption solution from the tank 13 for desorption solution entered adsorption columns 20 # to 1 # (ten adsorption columns operated in series through the channels in the multi-way valve, forming an adsorption tower N3) through the feeding pipe 4 for desorption solution to desorb the resin, resulting in a rich solution, of which a first half was discharged from the discharging pipe 10 for low-magnesium to the tank 16 for low-magnesium solution for use in the zone for pushing back brine by low-magnesium solution, and a second half was discharged into a tank 15 for the qualified liquid and was finally sent to a next step.

4. Zone for pushing back desorption solution by barren brine: After the desorption of the adsorbent was completed, some desorption solution containing trace lithium was left in the resin column, and in order to recover the left desorption solution and thus reduce consumption, the left desorption solution in the adsorption column was pushed back by the barren brine. The barren brine from the tank 14 for barren brine entered the adsorption column 2 # (one adsorption column operated in a single column, that is, the adsorption tower N4) through the feeding pipe 11 for barren brine for pushing back desorption solution, and the desorption solution containing trace lithium was discharged from the discharging pipe for desorption solution recovery into the tank for desorption solution.

The system had a feed flow rate of 2 t/h for the brine, twenty-eight resin columns in total, with each column being filled with 1 $m^3$ of resin and the total amount of adsorbent in the system being 28 $m^3$, and a switching time of 120 min. The brine at inlet had a lithium content of 3000 ppm and a magnesium ion concentration of 120 g/L. After treatment by the system, the adsorption tail fluid had a lithium ion concentration of 7 ppm and a magnesium ion concentration of 108 g/L. The qualified liquid had a lithium ion concentration of 510 ppm and a magnesium ion concentration of 2.2 g/L.

Example 4

An brine, desalted water at −30° C. as desorption solution, low-magnesium solution, and barren brine were passed through a feeding pipe 2 for brine, a feeding pipe 3 for low-magnesium solution for pushing back desorption solution, a feeding pipe 4 for desorption solution, and a feeding pipe 11 for barren brine for pushing back desorption solution respectively wherein the feeding pipes 2, 3, 4 and 11 were located above and below a rotary disc of a multi-way valve system 1 (with a valve diameter of 1.5 inches, a rotation switching time of 20 min), then passed through openings and channels within the multi-way valve system to respectively enter corresponding adsorption columns 6 (filled with Lithium adsorbent LX-10Li, produced by XI'AN SUN- RESIN NEW MATERIALS CO., LTD.), and finally respectively discharged from the a discharging pipe 7 for barren brine, a discharging pipe 8 for lithium-containing brine, a discharging pipe 9 for low-magnesium solution and a discharging pipe 10 for qualified liquid, thereby completing the whole process.

The distribution of each zone was as follows:

1. Adsorption zone: An brine from an tank 12 for brine entered adsorption columns 4 # to 15 # (twelve adsorption columns operated in series through the channels in the multi-way valve, forming an adsorption tower N1) through the feeding pipe 2 for brine, so that lithium ions were adsorbed on the adsorbent, and the brine which was free of lithium ions after adsorption entered a tank 14 for barren brine through the discharging pipe 7 for barren brine.

2. Zone for pushing back brine by low-magnesium solution: After the adsorbent was saturated, low-magnesium solution from the tank 16 for low-magnesium solution entered adsorption columns 16 # to 20 # (five adsorption columns operated in parallel through the channels in the multi-way valve, forming an adsorption tower N2) through the feeding pipe 3 for low-magnesium solution for pushing back desorption solution, so that the lithium-containing brine was pushed back by the low-magnesium solution to the tank 12 for brine to wait for the next adsorption.

3. Desorption zone by desorption solution: After the completion of pushing back lithium-containing brine by the low-magnesium solution, desorption solution from the tank 13 for desorption solution entered adsorption columns 21 # to 2 # (ten adsorption columns operated in parallel through the channels in the multi-way valve, forming an adsorption tower N3) through the feeding pipe 4 for desorption solution to desorb the resin, resulting in a rich solution, of which a first half was discharged from the discharging pipe 10 for low-magnesium to the tank 16 for low-magnesium solution for use in the zone for pushing back brine by low-magnesium solution, and a second half was discharged into a tank 15 for the qualified liquid and was finally sent to a next step.

4. Zone for pushing back desorption solution by barren brine: After the desorption of the adsorbent was completed, some desorption solution containing trace lithium was left in the resin column, and in order to recover the left desorption solution and thus reduce consumption, the left desorption solution in the adsorption column was pushed back by the barren brine. The barren brine from the tank 14 for barren brine entered the adsorption column 3 # (one adsorption column operated in a single column, that is, the adsorption tower N4) through the feeding pipe 11 for barren brine for pushing back desorption solution, and the desorption solution containing trace lithium was discharged from the discharging pipe for desorption solution recovery into the tank for desorption solution.

The system had a feed flow rate of 2 t/h for the brine, twenty-eight resin columns in total, with each column being filled with 1 $m^3$ of resin and the total amount of adsorbent in the system being 28 $m^3$, and a switching time of 20 min. The brine at inlet had a lithium content of 3000 ppm and a magnesium ion concentration of 120 g/L. After treatment by the system, the adsorption tail fluid had a lithium ion concentration of 14 ppm and a magnesium ion concentration of 109 g/L. The qualified liquid had a lithium ion concentration of 550 ppm and a magnesium ion concentration of 1.9 g/L.

Example 5

An brine, desalted water at −38° C. as desorption solution, low-magnesium solution, and barren brine were passed through a feeding pipe 2 for brine, a feeding pipe 3 for low-magnesium solution for pushing back desorption solution, a feeding pipe 4 for desorption solution, and a feeding pipe 11 for barren brine for pushing back desorption solution respectively wherein the feeding pipes 2, 3, 4 and 11 were located above and below a rotary disc of a multi-way valve system 1 (with a valve diameter of 1.5 inches, a rotation switching time of 10 min), then passed through openings and channels within the multi-way valve system to respectively enter corresponding adsorption columns 6 (filled with Lithium adsorbent LX-10Li, produced by XI'AN SUN-RESIN NEW MATERIALS CO., LTD.), and finally respectively discharged from the a discharging pipe 7 for barren brine, a discharging pipe 8 for lithium-containing brine, a discharging pipe 9 for low-magnesium solution and a discharging pipe 10 for qualified liquid, thereby completing the whole process.

The distribution of each zone was as follows:

1. Adsorption zone: An brine from an tank 12 for brine entered adsorption columns 5 # to 16 # (twelve adsorption columns operated in series through the channels in the multi-way valve, forming an adsorption tower N1) through the feeding pipe 2 for brine, so that lithium ions were adsorbed on the adsorbent, and the brine which was free of lithium ions after adsorption entered a tank 14 for barren brine through the discharging pipe 7 for barren brine.

2. Zone for pushing back brine by low-magnesium solution: After the adsorbent was saturated, low-magnesium solution from the tank 16 for low-magnesium solution entered adsorption columns 17 # to 21 # (five adsorption columns operated in series through the channels in the multi-way valve, forming the adsorption tower N2) through the feeding pipe for low-magnesium solution for pushing back desorption solution, so that the lithium-containing brine was pushed back by the low-magnesium solution to the tank 12 for brine to wait for the next adsorption.

3. Desorption zone by desorption solution: After the completion of pushing back lithium-containing brine by the low-magnesium solution, desorption solution from the tank 13 for desorption solution entered adsorption columns 22 # to 3 # (ten adsorption columns operated in series through the channels in the multi-way valve, forming an adsorption tower N3) through the feeding pipe 4 for desorption solution to desorb the resin, resulting in a rich solution, of which a first half was discharged from the discharging pipe 10 for low-magnesium to the tank 16 for low-magnesium solution for use in the zone for pushing back brine by low-magnesium solution, and a second half was discharged into a tank 15 for the qualified liquid and was finally sent to a next step.

4. Zone for pushing back desorption solution by barren brine: After the desorption of the adsorbent was completed, some desorption solution containing trace lithium was left in the resin column, and in order to recover the left desorption solution and thus reduce consumption, the left desorption solution in the adsorption column was pushed back by the barren brine. The barren brine from the tank 14 for barren brine entered the adsorption column 4 # (one adsorption column operated in a single column, that is, the adsorption tower N4) through the feeding pipe for barren brine for pushing back desorption solution, and the desorption solution containing trace lithium was discharged from the discharging pipe for desorption solution recovery into the tank for desorption solution.

The system had a feed flow rate of 2 t/h for the brine, twenty-eight resin columns in total, with each column being filled with 1 $m^3$ of resin and the total amount of adsorbent in the system being 28 $m^3$, and a switching time of 10 min.

The brine at inlet had a lithium content of 3000 ppm and a magnesium ion concentration of 120 g/L. After treatment by the system, the adsorption tail fluid had a lithium ion concentration of 37 ppm and a magnesium ion concentration of 109 g/L. The qualified liquid had a lithium ion concentration of 609 ppm and a magnesium ion concentration of 1.6 g/L.

Examples 6-12

According to the relevant verification effects of Examples 1 to 5, parameters such as the number of resin columns and the switching time in different zones were adjusted, and statistics were performed on the operation conditions, as shown in the following table (the solution concentrations in the table were all mass percent concentrations):

| Examples | Adsorption zone | Zone for pushing back brine by low-magnesium solution | Desorption zone | Zone for pushing back desorption solution by barren brine | Desorption solution | Desorption solution temp. ° C. | Switching time (h) |
|---|---|---|---|---|---|---|---|
| Example 6 | 12 in series | 3 in series | 15 in series | 1 | desalted water | 35 | 0.5 |
| Example 7 | 12 in parallel | 4 in series | 12 in series | 2 in series | desalted water | 50 | 0.8 |
| Example 8 | 6 in parallel 6 in series | 5 in series | 10 in series | 3 in series | desalted water | 25 | 1 |
| Example 9 | 3 in parallel 4 in series | 6 in series | 8 in series | 4 in series | 0.1% hydrochloric acid | 35 | 2 |
| Example 10 | 3 in parallel 5 in series | 7 in series | 6 in series | 1 | 36% hydrochloric acid | 20 | 3 |
| Example 11 | 3 in parallel 3 in series | 8 in series | 4 in series | 1 | 0.1% salt water | 38 | 0.25 |
| Example 12 | 4 in parallel 3 in series | 6 in series | 8 in series | 1 | 10% salt water | 30 | 0.2 |

The above-mentioned embodiments are only examples for clear description, and are not intended to limit the implementation manner. For those of ordinary skill in the art, changes or modifications in other different forms can also be made on the basis of the above description. There is no need and cannot be exhaustive of all implementations here. And the obvious changes or changes derived from this are still within the protection scope of the present invention.

The invention claimed is:

1. A method for extracting lithium from salt lake brine, comprising the following steps:

allowing a salt lake brine, desorption solution, low-magnesium solution and barren brine to pass through a feeding pipe for brine, a feeding pipe for desorption solution, a feeding pipe for low-magnesium solution for pushing back desorption solution and a feeding pipe for barren brine for pushing back desorption solution respectively, wherein the feeding pipes are located above and below a rotary disc of a multi-way valve system, then pass through openings and channels within the multi-way valve system to respectively enter corresponding adsorption columns, and finally discharge from a discharging pipe for barren brine, a discharging pipe for qualified liquid, a discharging pipe for lithium-containing brine and a discharging pipe for barren brine for pushing back desorption solution, thereby completing the whole process, wherein the adsorption columns are connected in series or in parallel via the channels in the multi-way valve system; and wherein the whole process comprises the following steps:

(1) in an adsorption zone, carrying out: feeding an brine from a tank for brine into an adsorption tower N1 through the feeding pipe for brine to perform adsorption of lithium ions onto an adsorbent, producing an barren brine free of lithium, and discharging the barren brine free of lithium into a tank for barren brine through the discharging pipe for barren brine;

(2) in a zone for replacing by low-magnesium solution, carrying out the following after the adsorbent is saturated: feeding a low-magnesium solution from a tank for low-magnesium solution into an adsorption tower N2 through a feeding pipe for low-magnesium solution to push back the lithium-containing brine that is not adsorbed by the adsorbent to the tank for brine to wait for the next adsorption;

(3) in a desorption zone by desorption solution, carrying out the following after the completion of pushing back lithium-containing brine by the low-magnesium solution: feeding a desorption solution from a tank for desorption solution into an adsorption tower N3 through the feeding pipe for desorption solution to desorb the resin, producing a rich solution, of which a first half is discharged through a discharging pipe for low-magnesium to the tank for low-magnesium solution for use in the zone for replacing by low-magnesium solution, and a second half is discharged into a tank for the qualified liquid and finally sent to the next step;

(4) in a zone for pushing back desorption solution by barren brine, carrying out: feeding the barren brine from the tank for barren brine into an adsorption tower N4 through the feeding pipe for barren brine for pushing back desorption solution, and discharging the desorption solution containing trace lithium through a discharging pipe for desorption solution recovery into the tank for desorption solution; and (5) setting a rotation time of the multi-way valve to realize shift of columns according to the process requirements, wherein the low-magnesium solution is an aqueous solution with a magnesium-to-lithium ratio (Mg/Li) lower than 10, and wherein the desorption solution is desalted water, and the temperature of the desorption solution is 30-40° C.

2. The new method for extracting lithium from salt lake brine of claim 1, wherein the number of the adsorption towers N1 N2, N3 and N4 is one or more, connected in series or parallel mode.

3. The new method for extracting lithium from salt lake brine of claim 1, wherein the number of the adsorption towers N1, N2, N3 and N4 can be matched with the channels of the multi-way valve system according to process requirements.

4. The new-method for extracting lithium from salt lake brine of claim 1, wherein each of the adsorption towers is filled with a lithium ion adsorbent.

5. The new method for extracting lithium from salt lake brine of claim 1, wherein the rotation shift time of the multi-way valve system is 0.01-24 hours.

6. The method for extracting lithium from salt lake brine of claim 1, comprising the following steps:

(1) feeding the salt lake brine at a flow rate of 2 BV/h into the N1 resin tower of the multi-way valve device to perform adsorption of lithium in the feed liquid by the resin in the resin column, and discharging out the resulted barren brine from the device;

(2) after the adsorbent is saturated, feeding the low-magnesium solution from the tank for low-magnesium solution into the adsorption tower N2 through the low-magnesium solution at a flow rate of 5 BV/h to push back the lithium-containing brine that is not adsorbed by the adsorbent to the tank for brine for the next adsorption;

(3) desorbing the N3 resin tower with a desalted water of 38° C. at a flow rate of 15 BV/h to produce a lithium chloride solution which then enters the tank for qualified liquid;

(4) replacing and recovering the water in the N4 resin tower by the barren brine at a flow rate of 0.8 BV/h; and (5) setting the multi-way valve to have a shift time of 24 min.

* * * * *